US006604339B2

(12) United States Patent
Zitella et al.

(10) Patent No.: US 6,604,339 B2
(45) Date of Patent: Aug. 12, 2003

(54) MULTI-TAB FOLDER FOR RING TYPE STRETCH FILM WRAPPING MACHINE, AND A METHOD OF OPERATING THE SAME

(75) Inventors: Marco Zitella, Montreal (CA); Kenneth J. Noakes, Pierrefonds (CA)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 10/342,360

(22) Filed: Jan. 15, 2003

(65) Prior Publication Data

US 2003/0101687 A1 Jun. 5, 2003

Related U.S. Application Data

(62) Division of application No. 09/947,466, filed on Sep. 7, 2001.

(51) Int. Cl.[7] ..... B65B 11/04

(52) U.S. Cl. ..... 53/157; 53/399; 53/556; 53/441; 53/445; 53/588; 53/540

(58) Field of Search ..... 53/399, 556, 441, 53/445, 157, 588, 540

(56) References Cited

U.S. PATENT DOCUMENTS 4,216,640 A * 8/1980 Kaufman ..... 53/556
4,587,796 A 5/1986 Haloila
5,144,787 A * 9/1992 Whitby et al. ..... 53/66
5,255,491 A * 10/1993 Marovskis et al. ..... 53/399
5,311,725 A * 5/1994 Martin et al. ..... 53/556
5,336,042 A * 8/1994 Winski et al. ..... 414/789.5
5,421,141 A * 6/1995 Gordon ..... 53/556
5,517,807 A 5/1996 Morantz
6,195,961 B1 3/2001 Turfan

* cited by examiner

*Primary Examiner*—Rinaldi I. Rada
*Assistant Examiner*—Brian Nash
(74) *Attorney, Agent, or Firm*—Schwartz & Weinrieb

(57) ABSTRACT

A new and improved film wrapping or packaging machine has incorporated therein a new and improved mechanism or system for implementing the downward folding of outwardly projecting edge or tab portions of slip sheets interposed between successive tiers, levels, or layers of articles or goods forming a palletized load. The folding mechanism or system comprises a plurality of vertically oriented posts which are initially disposed above the outwardly projecting tab portions, subsequently independently aligned with outer edge portions of the outwardly projecting tab portions of the slip sheets, and thereafter lowered so as engage the tab portions of the slip sheets and fold the same vertically downwardly against the vertical sides of the palletized load such that the downwardly folded tab portions can now be enveloped within the wrapping or packaging film. As the wrapping or packaging film constantly envelops the downwardly folded tab portions, the vertically oriented posts are being moved upwardly so as to constantly be released from their engagement positions with the tab portions until the wrapping or packaging operation or cycle is completed. The film wrapping carriage and the vertically oriented posts are then moved to uppermost positions in preparation for the start of a new wrapping or packaging cycle.

21 Claims, 6 Drawing Sheets

MULTI-TAB FOLDER FOR RING TYPE STRETCH FILM WRAPPING MACHINE, AND A METHOD OF OPERATING THE SAME

This patent application is a Divisional patent application of prior U.S. patent application Ser. No. 09/947,466, which was filed on Sep. 7, 2001.

FIELD OF THE INVENTION

The present invention relates generally to film wrapping machines, and more particularly to a new and improved ring-type film wrapping machine for wrapping, for example, palletized loads within stretch film, and a method of operating the same, wherein the ring frame member, which normally carries or supports a wrapping film carriage and a roll of wrapping film mounted thereon, also has operatively associated therewith a mechanism for implementing the downward folding of outwardly projecting tab or peripheral edge portions of the plurality of slip sheets, which are interposed between the different tiers of goods or articles disposed upon the support pallet in order to separate and support the different tiers of articles or goods upon the support pallet, such that the wrapping film can be applied to the palletized load in a uniform and tightly wrapped manner, and wherein further, the outwardly projecting tab or peripheral edge portions of the plurality of slip sheets will not puncture and therefore adversely affect the structural integrity of the wrapping film or that of the integrated wrapped palletized load.

BACKGROUND OF THE INVENTION

Ring-type film wrapping machines are well-known in the film wrapping industry for wrapping various articles, packages, loads, or the like, which are stacked and supported upon an underlying support pallet, within a suitable wrapping film. Examples of such ring-type film wrapping machines are disclosed, for example, within U.S. Pat. No. 6,195,961 which issued to Turfan on Mar. 6, 2001, U.S. Pat. No. 5,517,807 which issued to Morantz on May 21, 1996, and U.S. Pat. No. 4,587,796 which issued to Haloila on May 13, 1986. As can readily be appreciated, and as specifically disclosed, for example, within FIG. 1 of the present patent application drawings which corresponds to FIG. 1 of the aforenoted patent to Turfan, a conventional ring-type film wrapping machine 10 is seen to comprise a four-post upstanding framework 12 through which extends a conveyor 14 for transporting articles or palletized loads to be wrapped or packaged to a wrapping station 16 which is located substantially at the center of the region or boundary area peripherally defined by means of the upstanding posts of the framework 12. An upper horizontally disposed framework 18, which is vertically movable in a reciprocating manner with respect to the framework 12, rotatably supports a ring or circular track member 20 upon which is mounted a plastic film roll mounting and dispensing assembly 22 which includes a roll 24 of plastic wrapping film. Consequently, when the upper frame member 18 is moved in a vertically upward direction, after having been moved downwardly to a START position, and the ring or track member 20 is rotated with respect to the vertically movable upper frame member 18, film from the roll 24 of plastic wrapping film, mounted upon the film roll mounting and dispensing assembly 22, can be withdrawn or dispensed therefrom and applied to the articles or palletized loads which are disposed or located at the wrapping station 16 in preparation for being wrapped.

In order to form, for example, a stacked array of articles, packages, or loads upon the pallet, the articles, package, or loads are arranged within levels, layers, or tiers separated by means of suitable partitions or dividers known in the industry as slip sheets. The slip sheets present problems or difficulties, however, in connection with the actual wrapping of the articles, packages, or loads within the wrapping film. More particularly, since the peripheral edge portions of the slip sheets normally project externally beyond the peripheral vertical surfaces of the articles, packages, or loads disposed upon the pallet, such peripheral edge portions of the slip sheets do not readily permit the wrapping film to be applied to the palletized load in a uniform and tightly wrapped manner. In addition, the slip sheets are fabricated from a substantially rigid material and therefore the projecting peripheral edge portions of the slip sheets might cause penetration and puncture of the wrapping film thereby adversely affecting the structural integrity of the wrapping film as well as the integration or integral structure of the palletized load as formed in effect by the wrapped film.

A need therefore exists in the art for a new and improved mechanism, and a method of operating the same, for implementing the downward folding of the outwardly projecting tab or peripheral edge portions of the plurality of slip sheets, which are interposed between the different tiers of goods or articles disposed upon a support pallet in order to separate and support the different tiers of goods or articles upon the support pallet, such that the wrapping film can be applied to the palletized load in a tightly wrapped and uniform mode or manner, and wherein further the downwardly folded outwardly projecting tab or peripheral edge portions of the plurality of slip sheets will not adversely affect the structural integrity of the wrapping film or that of the integrated wrapped palletized load.

OBJECTS OF THE INVENTION

Accordingly, it is an object of the present invention to provide a new and improved mechanism, and a method of operating the same, for implementing the downward folding of the outwardly projecting tab or peripheral edge portions of the plurality of slip sheets which are interposed between the different tiers of goods or articles disposed upon a support pallet in order to separate and support the different tiers of goods or articles upon the support pallet.

Another object of the present invention is to provide a new and improved mechanism, and a method of operating the same, for implementing the downward folding of the outwardly projecting tab or peripheral edge portions of the plurality of slip sheets, which are interposed between the different tiers of goods or articles disposed upon a support pallet in order to separate and support the different tiers of goods or articles upon the support pallet, whereby such outwardly projecting tab or peripheral edge portions of the plurality of slip sheets will no longer present the operational disadvantages or drawbacks characteristic of PRIOR ART palletized load wrapping film systems.

An additional object of the present invention is to provide a new and improved mechanism, and a method of operating the same, for implementing the downward folding of the outwardly projecting tab or peripheral edge portions of the plurality of slip sheets, which are interposed between the different tiers of goods or articles disposed upon a support pallet in order to separate and support the different tiers of goods or articles upon the support pallet, whereby such outwardly projecting tab or peripheral edge portions of the plurality of slip sheets will no longer operatively interfere with the film wrapping operation being performed upon or in connection with the palletized load.

A further object of the present invention is to provide a new and improved mechanism, and a method of operating the same, for implementing the downward folding of the outwardly projecting tab or peripheral edge portions of the plurality of slip sheets, which are interposed between the different tiers of goods or articles disposed upon a support pallet in order to separate and support the different tiers of goods or articles upon the support pallet, whereby such outwardly projecting tab or peripheral edge portions of the plurality of slip sheets will no longer adversely affect the structural integrity of the wrapping film as well as the structural integrity of the integrated palletized load.

A last object of the present invention is to provide a new and improved mechanism, and a method of operating the same, for implementing the downward folding of the outwardly projecting tab or peripheral edge portions of the plurality of slip sheets, which are interposed between the different tiers of goods or articles disposed upon a support pallet in order to separate and support the different tiers of goods or articles upon the support pallet, whereby such outwardly projecting tab or peripheral edge portions of the plurality of slip sheets will no longer prevent the application of the wrapping film to and upon the palletized load in a uniform and tightly wound manner.

SUMMARY OF THE INVENTION

The foregoing and other objectives are achieved in accordance with the teachings and principles of the present invention through the provision of a new and improved mechanism, and a method for operating the same, for implementing the downward folding of the outwardly projecting tab or peripheral edge portions of the plurality of slip sheets, which are interposed between the different tiers of goods or articles disposed upon a support pallet in order to separate and support the different tiers of goods or articles upon the support pallet, wherein such mechanism comprises a second or auxiliary framework which, in a manner similar to that of the first or primary framework which rotatably supports the ring or circular track member and the plastic film roll mounting and dispensing assembly, is likewise vertically movable with respect to the four-post up-standing framework. The second or auxiliary framework comprises four independently movable framework members arranged in oppositely disposed pairs and wherein each one of the frame members has a pair of vertically oriented posts fixedly mounted thereon. The framework members are movable toward each other so as to locate the pairs of vertically oriented posts at positions immediately adjacent to the outermost edge or extremity portions of the plurality of slip sheets, and subsequently, the auxiliary framework will be lowered with respect to the four-post upstanding framework such that the vertically oriented posts cause the outwardly projecting edge or peripheral portions of the slip sheets to be folded downwardly against, adjacent, or parallel to the vertically oriented surfaces of the palletized load.

When the film wrapping operation is then commenced, the auxiliary framework is raised or elevated, along with the first or primary framework upon which the film roll mounting and dispensing assembly is disposed, such that as the palletized load is wrapped within the wrapping film from the lower end portion thereof to the upper end portion thereof, the downwardly folded edge portions of the slip sheets are accordingly temporarily secured in such a state by means of the vertical posts and are ultimately secured in such a state by means of the wrapping film. In view of the fact that the auxiliary framework posts are constantly being raised or elevated as the lower levels of the palletized load are being sequentially wrapped within the wrapping film, only a predetermined extent of the lower end portions of the posts are enveloped within the wrapping film at any one time. In addition, the lower end portions of the posts are coated with, for example, polytetrafluoroethylene (TEFLON®) so as to facilitate their subsequent withdrawal from the wrapped film as the first and second or primary and auxiliary frameworks are raised during the entire film wrapping operation or cycle.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
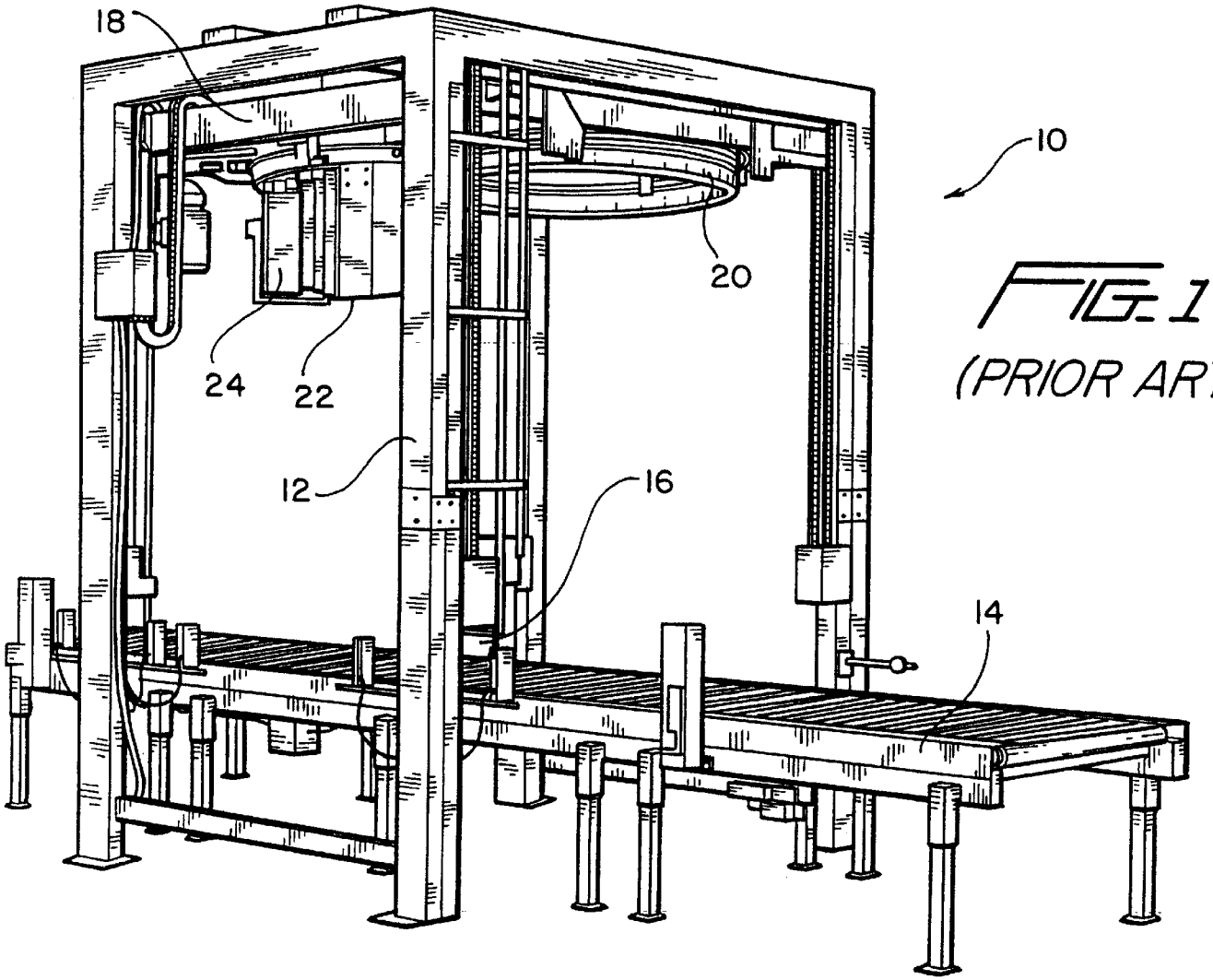
FIG. 1 (PRIOR ART)
FIG. 1 is a perspective view of a conventional, PRIOR ART four-post film wrapping or packaging machine or apparatus for use in connection with the packaging or wrapping of articles or palletized loads at a wrapping station defined within the confines of the perimeter defined by means of the four upstanding posts of the machine or apparatus framework.
Figure 3:
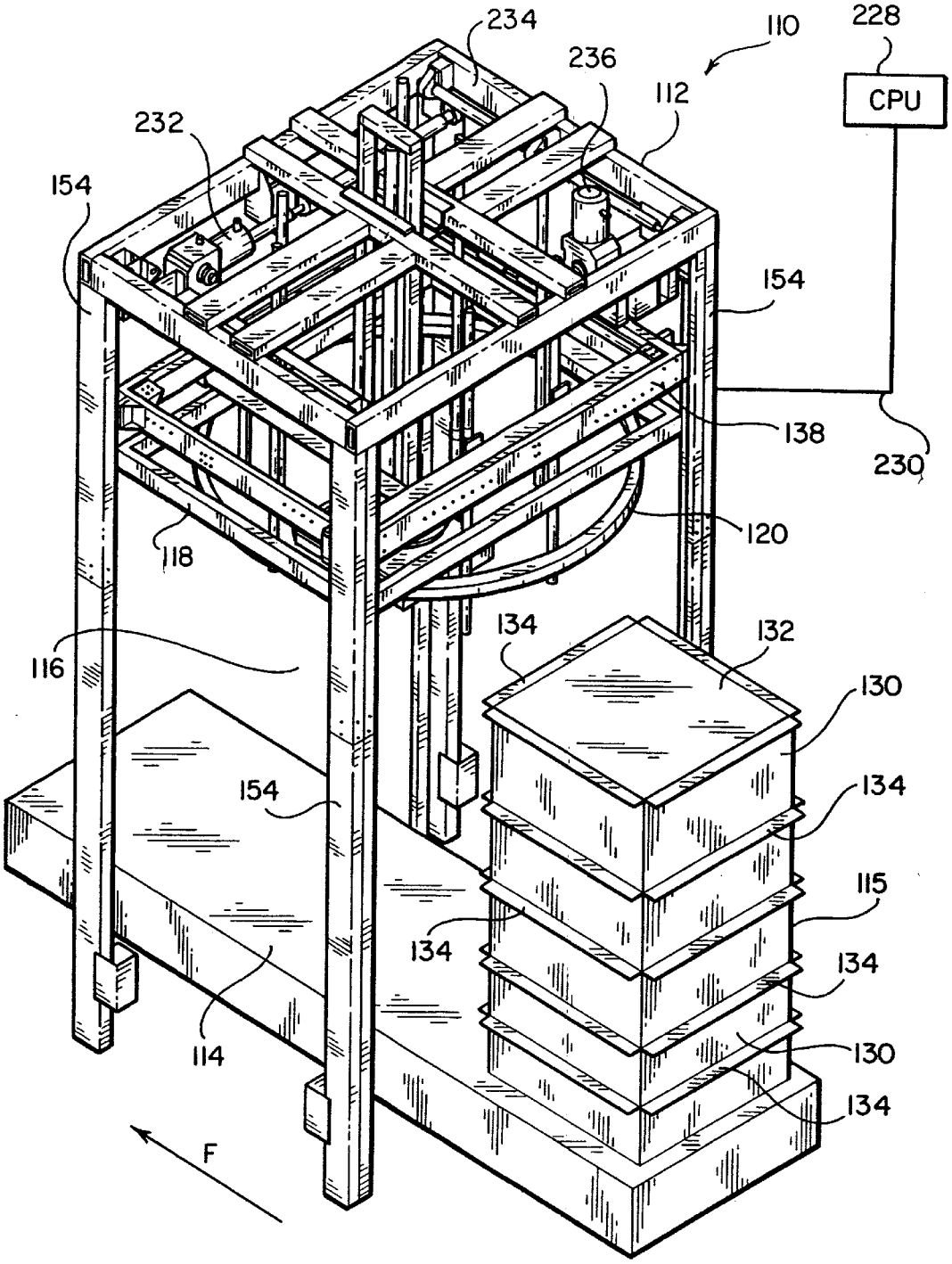
FIG. 3 is a perspective view of a four-post film wrapping or packaging machine or apparatus, similar to the four-post film wrapping or packaging machine shown in FIG. 1, showing, however, the incorporation therein of the new and improved four-sided auxiliary framework assembly, as disclosed within FIG. 2, wherein the first or primary and second or auxiliary framework assemblies of the film wrapping or packaging machine are disposed at their uppermost raised or START positions, and a palletized load is being conveyed toward the wrapping station.

Referring now to the drawings, and more particularly to FIG. 3 thereof, a new and improved film wrapping or packaging machine, for wrapping or packaging palletized loads within a wrapping or packaging film, is disclosed and is generally indicated by the reference character 110. It is to be noted that the basic components of the film wrapping or packaging machine 110 are similar to the basic components of the PRIOR ART wrapping and packaging machine 10 as shown in FIG. 1, and accordingly, such components will be briefly described and designated by corresponding reference numbers, except that the reference numbers designating the components of the new and improved film wrapping or packaging machine of the present invention will be within the 100 series.

More particularly, it is seen that the new and improved film wrapping or packaging machine 110 of the present invention comprises a four-post upstanding framework 112 through which extends a conveyor 114 for transporting articles or a palletized load 115, to be wrapped or packaged, in a predetermined flow direction, as indicted by arrow F, toward a wrapping station 116 which is located substantially at the center of the region or boundary area peripherally defined by means of the upstanding posts of the framework 112. A lower horizontally disposed framework 118, which is vertically movable in a reciprocating manner with respect to the framework 112, rotatably supports a ring or circular track member 120 upon which is mounted a plastic film roll mounting and dispensing assembly, not shown, which includes a roll of plastic wrapping film, also not shown. Consequently, when the lower frame member 118 is moved in a vertically upward direction, after having been initially lowered to a STOP position, and the ring or track member 120 is rotated with respect to the vertically movable lower frame member 118, film from the roll of plastic wrapping film, not shown, mounted upon the film roll mounting and dispensing assembly, also not shown, can be withdrawn or dispensed therefrom and applied to the articles or palletized load 115 which are disposed or located at the wrapping station 116 in preparation for being wrapped.

In connection with the present invention, the palletized load 115 to be wrapped in plastic film is disclosed in FIG. 3 and comprises, for example, a stacked array of goods or products which are arranged within several levels, layers, or tiers 130, and in order to support and separate each one of the levels, layers, or tiers 130 of the articles or products within the vertical array or stack comprising the palletized load 115, a plurality of slip sheets 132 are respectively interposed between successive ones of the levels, layers, or tiers 130 of the articles or products, as well as atop the uppermost level, layer, or tier 130 of the articles or products. In order to adequately or properly support or separate the different levels, layers, or tiers 130 of the articles or products within the palletized load 115, it is noted that the outer peripheral edge portions of the slip sheets 132 usually extend beyond the outer vertical peripheral surface portions of the articles or products forming each one of the levels, layers, or tiers 130 of articles or products so as to define, in effect, outwardly projecting tab portions 134 upon all four sides of the palletized load 115. As can readily be appreciated, however, the outwardly projecting tab portions 134 of the slip sheets 132 present operational problems and difficulties in connection with the proper wrapping or packaging of the palletized load 115. For example, in view of the fact that the slip sheets 132 are fabricated from a relatively strong and rigid material, such as, for example, a suitable cardboard, the outwardly projecting edge portions or tabs 134 of the slip sheets 132, including the presence of relatively sharp corner regions, present means for the puncturing or tearing of the wrapping or packaging film, when the same is wrapped around the palletized load 115, whereby the structural integrity of the wrapping or packaging film, as well as that of the integration of the entire wrapped or packaged palletized load 115, is adversely affected and potentially compromised. In addition, even if puncture or tearing of the wrapping or packaging film does not occur, the outward projection of the tab portions 134 of the slip sheets 132 militates against the uniform and tight or secure wrapping or packaging of the palletized load 115 within the wrapping or packaging film.

It is therefore desirable to fold the outwardly projecting tab portions 134 of the slip sheets 132 downwardly such that the downwardly folded tab portions 134 of the slip sheets 132 will ultimately be disposed within vertical planes against, adjacent, or parallel to the vertical peripheral surfaces of the different levels, layers, or tiers 130 of the articles or goods comprising the palletized load 115. Accordingly, in accordance with the principles and teachings of the present invention, there has been developed apparatus for achieving the downward folding of the outwardly projecting tab portions 134 of the slip sheets 132, in conjunction with the wrapping or packaging of the palletized load 115 within the wrapping or packaging film, such that the downwardly folded tab portions 134 effectively conform to the overall structural configuration of the palletized load 115, as defined by means of the vertical side or peripheral surfaces of the different levels, layers, or tiers 130 of the articles or goods comprising the palletized load 115, so as not to present any structure to the wrapping or packaging film which might adversely affect the structural integrity thereof, and so as not to interfere with the uniform and secure wrapping or packaging of the palletized load 115 within the wrapping or packaging film.

Figure 2:
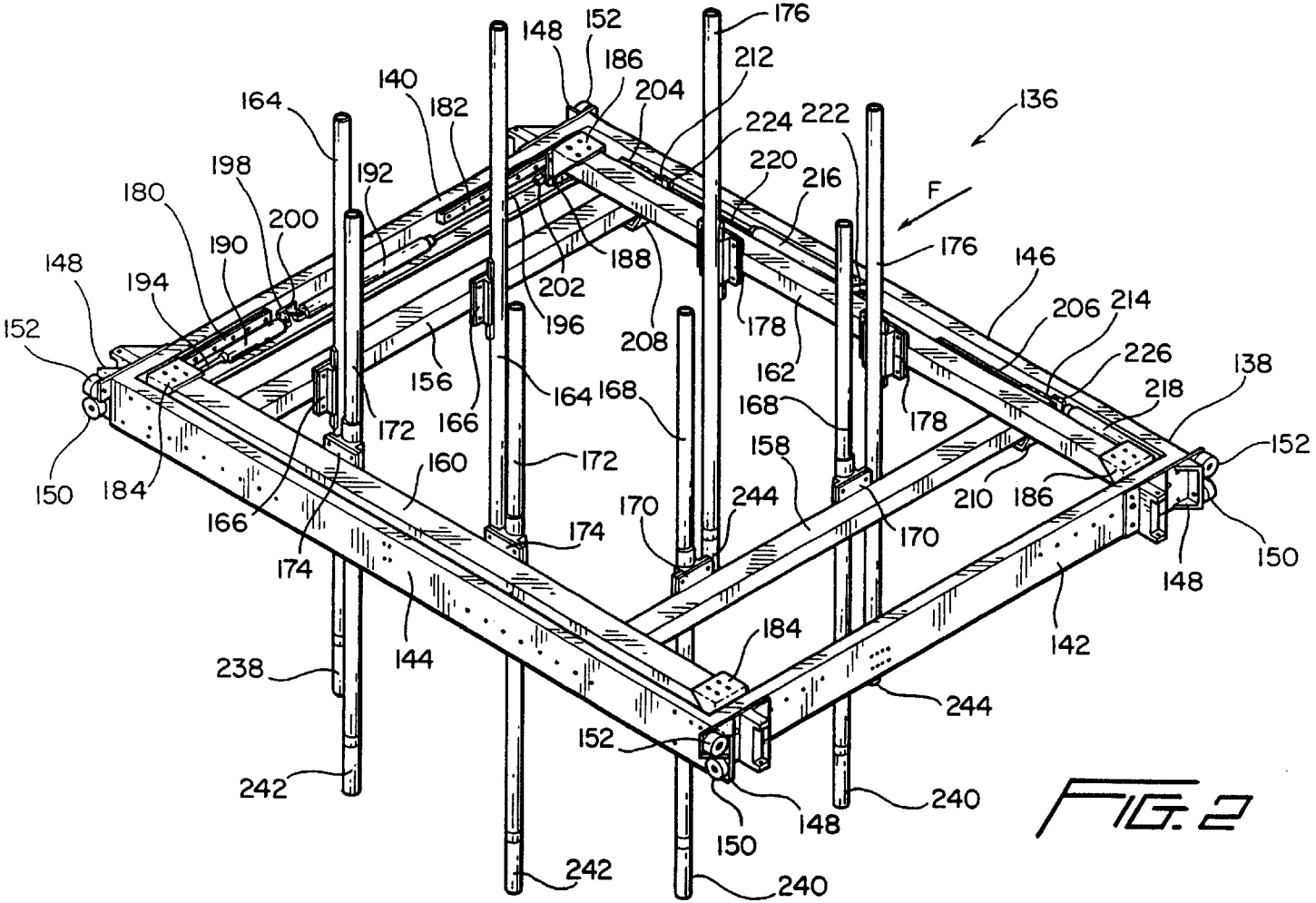
FIG. 2 is a perspective view of a new and improved four-sided auxiliary framework assembly wherein pairs of vertically oriented posts are mounted upon each one of the four independently movable sides of the framework for performing a fold-down operation in connection with outwardly projecting side edge portions of a plurality of slip sheets which have been inserted between consecutive levels, layers, or tiers of goods or articles comprising a palletized load.

More particularly, with additional reference being specifically made to FIG. 2, a multi-tab folding mechanism, assembly, or system for folding the outwardly projecting tab portions 134 of the slip sheets 132 in the downward direction, is disclosed and is generally indicated by the reference character 136. The multi-tab folding mechanism, assembly, or system 136 is seen to comprise an outer, four-sided upper framework 138 which is adapted to be mounted upon the film wrapping or packaging machine 110 so as to be vertically movable along the four-post upstanding framework 112 as can be appreciated from FIG. 3, and the orientation of the framework 138, relative the direction in which the incoming palletized load 115 is conveyed to the wrapping or packaging station 116, is denoted by the arrow F so as to properly correlate the disposition and illustration of the framework 138 within FIGS. 2 and 3. The framework 138 comprises a pair of oppositely disposed side frame members 140 and 142, and a pair of oppositely disposed end frame members 144 and 146 which are rigidly fixed to the pair of oppositely disposed side frame members 140,142 such as, for example, by being welded thereto. Each external corner region of the framework 138 is provided with a mounting bracket 148 upon which a pair of rollers or wheels 150 and 152 are rotatably mounted, and it is noted that the rotational axes of the rollers or wheels 150,152 are disposed perpendicular to each other such that the rollers or wheels 150,152 can rotatably move along perpendicular surfaces which define interior corner regions of each one of the upstanding vertical posts 154 of the four-post upstanding framework 112.

Internally within the rigid framework 138, there is disposed a plurality of movable framework members for respectively mounting a plurality of vertically oriented posts which will be utilized to achieve the downward folding of the outwardly projecting tab portions 134 of the slip sheets 132. More particularly, it is seen that a first pair of oppositely disposed, movable framework members or side post supports 156 and 158 are adapted to be movable toward and away from the oppositely disposed side frame members 140, 142, and a second pair of oppositely disposed, movable framework members or end post supports 160 and 162 are adapted to be movable toward and away from the oppositely disposed end frame members 144,146. It is further appreciated that the first pair of oppositely movable side post supports 156,158 are movably disposed within a first plane, while the second pair of oppositely movable end post supports 160,162 are movably disposed within a second plane, wherein the second plane within which the second pair of oppositely movable end post supports 160,162 are disposed is located above the first plane within which the first pair of oppositely movable side post supports 156,158 are movably disposed. In this manner, independent movement of each one of the side and end post supports 156, 158,160,162, by itself and with respect to the other side and end post supports, is facilitated and able to be achieved. Still further, it is seen that a first pair of vertically oriented posts 164 are fixedly mounted upon the side post support 156 in a longitudinally spaced manner by means of a pair of suitable mounting brackets 166, a second pair of vertically oriented posts 168 are fixedly mounted upon the side post support 158 in a longitudinally spaced manner by means of a pair of suitable mounting brackets 170, a third pair of vertically oriented posts 172 are fixedly mounted upon the end post support 160 in a laterally spaced manner by means of a pair of suitable mounting brackets 174, and a fourth pair of vertically oriented posts 176 are fixedly mounted upon the end post support 162 in a laterally spaced manner by means of a pair of suitable mounting brackets 178.

Continuing still further with reference still being made to FIG. 2, each one of the oppositely disposed side frame members 140,142 of the framework 138 is provided with a pair of longitudinally spaced linear bearing rails 180 and 182, although it is noted that the bearing rails mounted upon the side frame member 142 are not visible, and the opposite ends of each one of the end post supports 160, 162 are respectively provided with corner brackets 184 and 186. Suspension brackets 188 are operatively connected to each one of the corner brackets 184,186, although only one of the suspension brackets 188 is visible in connection with one of the corner brackets 186, and the upper end portion of each corner bracket 184,186 is slidably mounted upon each one of the linear bearing rails 180 and 182. Each one of the oppositely disposed side frame members 140,142 of the framework 138 is further provided with a pair of longitudinally spaced, and oppositely oriented pneumatic cylinder assemblies 190 and 192, although, again, as was the case with respect to the linear bearing rails 180,182, only the pneumatic cylinder assemblies 190,192 mounted upon the side frame member 140 of the framework 138 are visible. With respect to the pneumatic cylinder assemblies mounted upon the side frame member 140 of the framework 138, it is seen that each one of the pneumatic cylinder assemblies 190,192 respectively comprises a piston rod 194 and 196, and it is further seen that the cylinder end of each cylinder assembly 190,192 is respectively pivotally mounted upon the side frame member 140 of the framework 138 by means of a suitable bracket 198 and 200, while the external end of each piston rod 194 and 196 is respectively connected to one of the suspension brackets 188 by means of a clevis connector 202, only one of which is visible.

It is further noted that the pneumatic cylinder assemblies 190 and 192 are oppositely oriented with respect to each other, that is, their piston rods 194,196 project outwardly from their respective assemblies 190,192 in opposite directions, and that the stroke or length of the pneumatic cylinder assembly 192 and its piston rod 196 is greater than the stroke or length of the pneumatic cylinder assembly 190 and its piston rod 194. In this manner, as will be discussed more fully hereinafter, different palletized loads, having different length dimensions as considered in the conveyor infeed flow direction F, can be accommodated within or by the slip sheet tab folding system 136 of the present invention. It is also noted that the respective assemblies 190,192 have their pistons rods 194,196 so positioned that the distance defined between the end post supports 160,162 is maximized.

In a manner similar to that concerning each one of the oppositely disposed side frame members 140,142 and the oppositely disposed end post supports 160 and 162 slidably mounted thereon, each one of the oppositely disposed end frame members 144,146 of the framework 138 is provided with a pair of laterally or transversely spaced linear bearing rails 204 and 206, although it is noted that the bearing rails mounted upon the end frame member 144 are not visible, and the opposite ends of each one of the side post supports 156,158 are respectively provided with corner brackets 208 and 210. Suspension brackets 212 and 214 are operatively connected to each one of the corner brackets 208,210, although only one of the suspension brackets 212,214 is visible in connection with each one of the corner brackets 208, 210, and the upper end portion of each corner bracket 208, 210 is slidably mounted upon each one of the linear bearing rails 204,206. Each one of the oppositely disposed end frame members 144 and 146 of the framework 138 is further provided with a pair of laterally or transversely spaced pneumatic cylinder assemblies 216 and 218, although, again, as was the case with respect to the linear bearing rails 204 and 206, only the pneumatic cylinder assemblies 216 and 218 mounted upon the end frame member 146 of the framework 138 are visible. With respect to the pneumatic cylinder assemblies mounted upon the end frame member 146 of the framework 138, it is seen that each one of the pneumatic cylinder assemblies 216 and 218 respectively comprises a piston rod, only piston rod 220 of cylinder assembly 216 being visible, and it is further seen that the cylinder end of each cylinder assembly 216,218 is pivotally mounted upon the end frame member 146 of the framework 138 by means of a suitable bracket, only bracket 222 of cylinder assembly 216 being visible, while the external end of the piston rod 220, and the piston rod of cylinder assembly 218 which is not visible, is respectively connected to one of the suspension brackets 212, 214 by means of a clevis connector 224 and 226. It is further noted that unlike the pneumatic cylinder assemblies 190,192, the pneumatic cylinder assemblies 216, 218 are oriented in the same direction with respect to each other, that is, their piston rods project outwardly from their respective assemblies 216,218 in the same directions, however, the piston rod, which is not visible, of cylinder assembly 218 is illustrated as being fully retracted, while the piston rod 220 of the cylinder assembly 216 is illustrated as being fully extended whereby the distance defined between side post supports 156,158 is maximized. In this manner, different palletized loads, having different width dimensions as considered with respect to the conveyor infeed flow direction F, can in fact be accommodated within or by the slip sheet tab folding system 136 of the present invention.

With reference now being made to FIGS. 2–6, the operation of the new and improved slip sheet tab folding system 136, in conjunction with the film wrapping machine 110, will now be described. It is to be initially noted that the entire film wrapping or packaging machine 110 is automatically operable and is therefore suitably controlled by means of a central processing unit (CPU) 228 as shown in FIGS. 3–6. More particularly, while the film wrapping or packaging machine 110 has been schematically illustrated as being operatively connected to the central processing unit (CPU) by means of a generic signal line 230, it is to be appreciated that the various individual operative components and sensors of the film wrapping or packaging machine 110, as well as those of the tab folding assembly or system 136, will be individually connected to the central processing unit (CPU) 228 by means of individual signals lines as necessary, not shown for brevity and clarity.

Accordingly, at the start of a film wrapping or packaging operation, which is commenced, for example, by means of an operator pushing a START button, not shown, located upon a suitable operator console or at an operator station, also not shown, a palletized load 115 to be wrapped or packaged is disposed at a START position, as shown in FIG. 3, whereby the conveyor 114 feeds the palletized load 115 in the infeed conveying direction F so as to move the palletized load 115 toward the wrapping or packaging station 116. During this first phase or stage of the film wrapping or packaging operation or cycle, the lower frame member 118 and the ring or track member 120, as well as the slip sheet tab folding system 136 comprising the framework 138 as shown in FIG. 3, are disposed at their uppermost raised positions. In order to achieve the vertically reciprocal movements of the lower frame member 118 and the ring or track member 120 with respect to the four-post framework 112, a first motor drive 232 is fixedly mounted upon an upper framework portion 234 of the four-post framework 112, while a second motor drive 236 is similarly mounted upon the upper framework portion 234 of the four-post framework 112 so as to control the vertical movements of the slip sheet tab folding framework 138.

Figure 4:
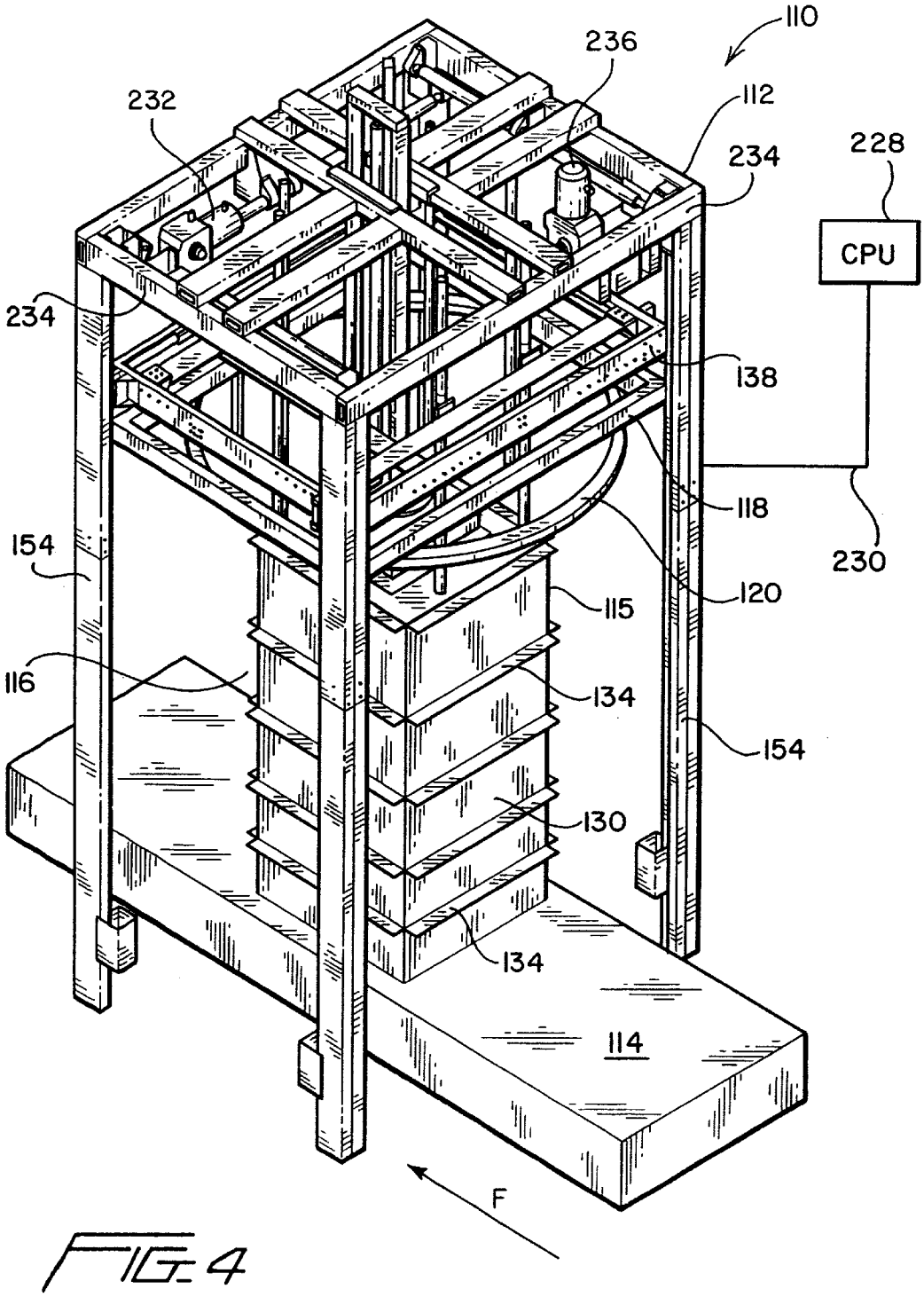
FIG. 4 is a perspective view similar to that of FIG. 3 showing, however, the packaging machine at a HOME position wherein the palletized load is disposed at the wrapping station, the first framework is readied to be lowered to its STOP position, and the second framework is readied to be lowered from its initial START position to a load height detection position in preparation for inward movement of each one of the auxiliary framework post support members to an aligned position at which the vertically oriented posts are readied to fold the outwardly projecting edge or tab portions of the slip sheets in the downward direction.

The four-post framework 112 is additionally provided with a suitable sensor, not shown, such as, for example, a photoeye, photodetector, or the like, which will detect the presence or disposition of the palletized load 115 at a predetermined location along the conveyor 114 and with respect to the wrapping or packaging station 116 such that when the front end of the palletized load 115, as considered in the infeed direction F, reaches the predetermined location, the central processing unit (CPU) terminates further operation of the conveyor 114. This disposition of the palletized load 115 is shown in FIG. 4 wherein the palletized load 115 is now disposed at a HOME position. At such position, the first motor drive 232 is activated so as to move the lower frame member 118 and the ring or track member 120 downwardly with respect to the four-post framework 112 such that the lower frame member 118 and the ring or track member 120 are disposed at their lowermost position in preparation for the commencement of a film wrapping or packaging operation or cycle. In addition, the central processing unit (CPU) 228 energizes the second motor drive 236 such that the the slip sheet tab folding framework 138 begins to be lowered. An array of additional sensors, such as, for example, photoeyes or photodetectors, also not shown and which may be mounted either upon the four-post framework 112 or upon the slip sheet tab folding framework 138, detect the height dimension of the palletized load 115, whereupon conveyance of such information to the central processing unit (CPU) 228, the central processing unit (CPU) 228 de-energizes the second motor drive 236. The various slip sheet tab folding posts 164-164,168-168,172-172,176-176 are now disposed in a readied or standby position at which the tab folding posts 164-164,168-168, 172-172,176-176 can be properly aligned with respect to the outwardly projecting tab portions 134 of the slip sheets 132 in preparation for the vertically downward folding of the slip sheet tab portions 134.

More particularly, with reference again being made specifically to FIG. 2, it is seen that the lower end portion of the each one of the tab folding posts 164-164,168-168, 172-172,176-176 is respectively provided with a sensor housing 238,240,242,244 within which a vertically oriented photoeye or photodetector, not shown, is housed. Consequently, after the slip sheet tab folding framework 138 has been lowered to and stopped at the predetermined height level located immediately above the upper extent of the palletized load 115, central processing unit (CPU) 228 will generate command signals to the various pneumatic cylinder assemblies 190,192,216,218 such that the same are activated whereby the various, oppositely disposed pairs of tab folding post supports 156 and 158, and 160 and 162 are independently movable in an inward direction toward each other. When the photoeyes or photodetectors, not shown, housed within the various sensor housings 238–244 mounted upon their respective tab folding posts 164-164, 168-168,172-172,176-176 detect the respective edge portions of the outwardly projecting tabs 134 of the slip sheets 132, signals indicating the detected presence of the projecting tab portions 134 will be independently conveyed back to the central processing unit (CPU) 228 whereby the central processing unit (CPU) 228 will, in turn, generate command signals to the pneumatic cylinder assemblies 190,192,216, 218 so as to terminate further activation of the pneumatic cylinder assemblies 190,192,216,218.

Accordingly, each one of the tab folding posts 164-164, 168-168,172-172,176-176 will now be properly aligned with its respective one of the outwardly projecting tab portions 134 of the slip sheets 132 in preparation for the actual fold-down operation thereof. It is to be noted that the pneumatic cylinder assemblies 190,192,216,218 are position-feedback type assemblies which means that as a result of their operative connection to the central processing unit (CPU) 228, and the positional data, characteristic of the alignment positions or locations of the tab folding posts 164-164,168-168,172-172,176-176 with respect to their respective slip sheet tab portions 134, which has automatically been entered into the memory of the central processing unit (CPU) 228, should the disposition or location of any one of the tab folding posts 164-164,168-168,172-172,176-176 be momentarily altered due, for example, to vibrations or other forces which may be operative upon the machine 110, the central processing unit (CPU) 228 will automatically correct or compensate for such location errors and ensure that the tab folding posts 164-164,168-168,172-172,176-176 are in fact located and retained at their proper alignment positions with respect to their respective slip sheet tab portions 134. Upon the tab folding posts 164-164,168-168, 172-172,176-176 therefore attaining their proper aforenoted alignment positions with respect to the outwardly projecting tab portions 134 of the palletized load slip sheets 132, the apparatus or system 136 is then readied to commence the actual downward folding of the tab portions 134 of the slip sheets 132 and the subsequent film wrapping or packaging operation.

Figure 5:
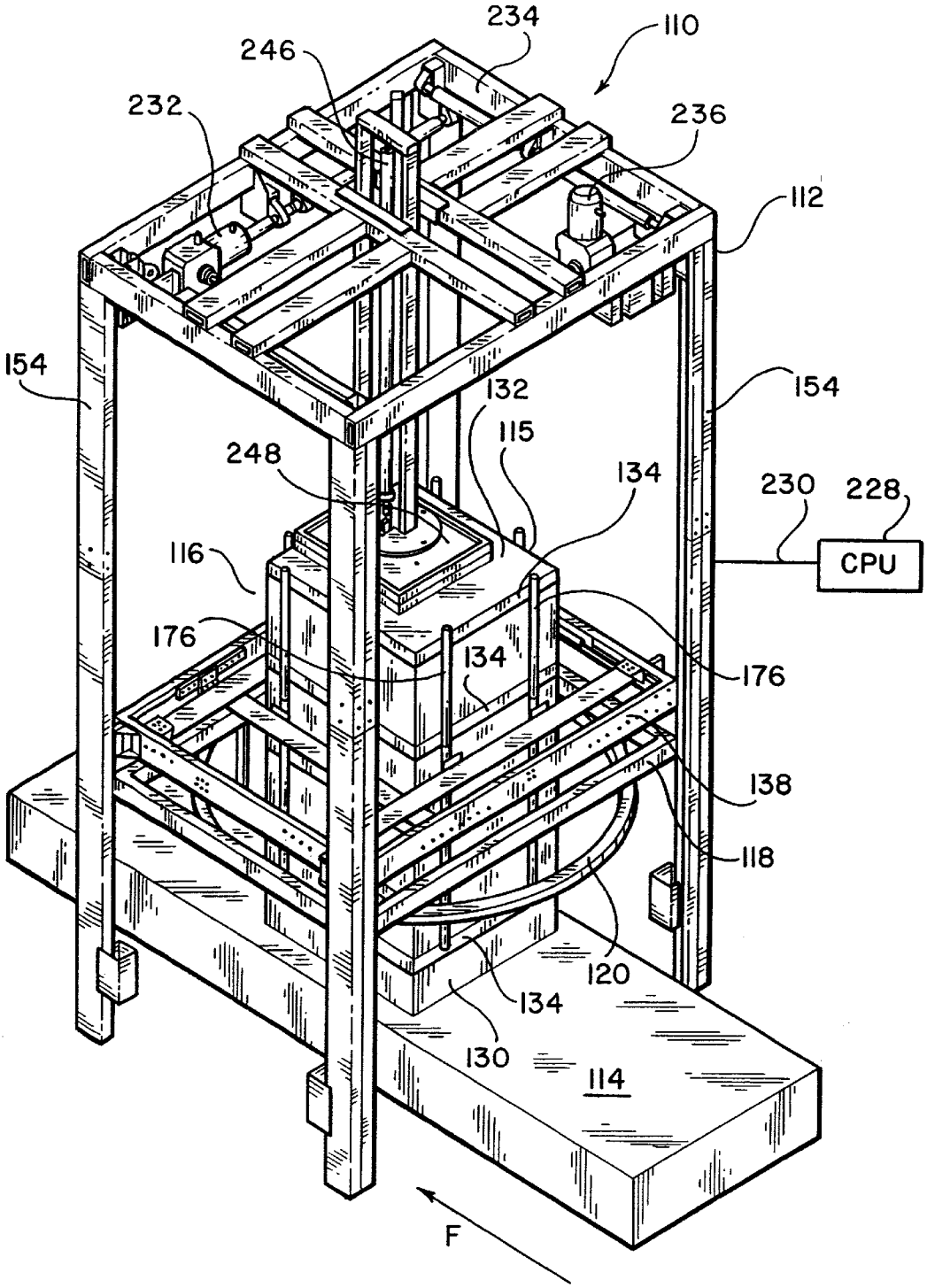
FIG. 5 is a perspective view similar to that of FIGS. 3 and 4 and therefore showing the four-post film wrapping or packaging machine or apparatus wherein, however, the first or primary and second or auxiliary frameworks are now disposed at their lowermost STOP positions in preparation for the commencement of the film wrapping operation, all of the outwardly projecting edge or tab portions of the plurality of slip sheets having been folded downwardly and maintained at such folded positions as a result of their engagement by the vertically oriented posts of the second or auxiliary framework.

Accordingly, upon completion of the movement of the tab folding posts 164-164,168-168,172-172,176-176 to their proper aforenoted alignment positions, the central processing unit (CPU) 228 issues a command to a pneumatic actuator assembly 246, which is also mounted upon the upper framework portion 234 of the four-post framework 112, so as to lower a platen member 248, which is fixedly mounted upon the lower end portion of actuator assembly 246, such that the platen member 248 engages the uppermost one of the plurality of slip sheets 132. The central processing unit (CPU) 228 also issues a command to the second motor drive 236 so as to lower the slip sheet tab folding post support framework 138 upon which the tab folding posts 164-164,168-168, 172-172,176-176 are mounted. It is to be noted that in accordance with an alternative mode of operation, in lieu of the lower frame member 118 and the ring or track member 120 being previously moved to their lowermost position in preparation for the commencement of the film wrapping or packaging operation or cycle, the lower frame member 118 and the ring or track member 120 can be moved to such lowermost position in conjunction with the downward movement of the slip sheet tab folding post support framework 138. In either case, such components of the film wrapping or packaging machine 110 are now disposed at their respective STOP positions as illustrated in FIG. 5 at which it is apparent that each set of the tab folding posts 164-164,168-168, 172-172,176-176 is operatively engaged in effect with a side surface portion of the palletized load 115 so as to not only have folded the outwardly projecting tab portions 134 of the slip sheets 132 in the downward direction, but the tab folding posts 164-164,168-168,172-172,176-176 have sufficient vertical extents so as to effectively span the distance defined between the lowermost tab portion 134 and the uppermost tab portion 134 so as to be capable of maintaining the outwardly projecting tab portions 134 of the slip sheets 132 in such downwardly folded states throughout the film wrapping or packaging cycle.

Figure 6:
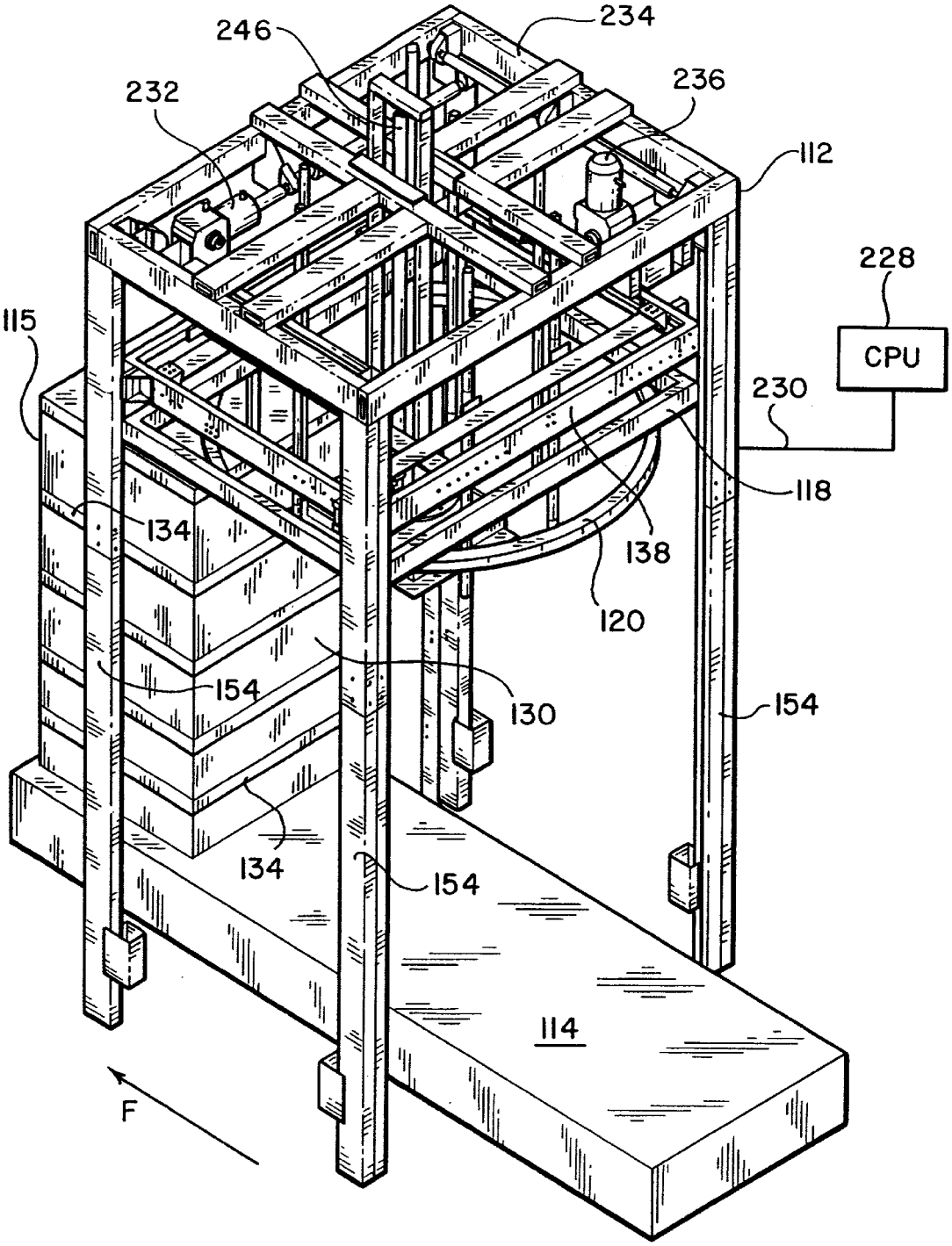
FIG. 6 is a perspective view similar to that of FIGS. 3–5 and therefore showing the four-post film wrapping or packaging machine or apparatus wherein, however, the first or primary and second or auxiliary frameworks are again disposed at their uppermost raised or START positions upon completion of the film wrapping or packaging operation, and wherein further, the wrapped or packaged palletized load is being conveyed out of the wrapping station.

The film wrapping or packaging machine 110 is now ready to actually initiate a film wrapping or packaging cycle. Accordingly, central processing unit (CPU) 228 initiates command signals to the motor drives 232 and 236 so as to appropriately raise the framework 118 and the ring or track member 120 upon which the film dispensing carriage assembly, not shown, is mounted, and the slip sheet tab folding post support framework 138 upon which the tab folding posts 164-164, 168-168,172-172,176-176 are mounted, from their relative positions as shown in FIG. 5 toward their END positions as shown in FIG. 6, as well as to initiate rotation of the ring or track member 120 upon which the wrapping or packaging film roll is mounted so as to thereby dispense the wrapping or packaging film therefrom, whereby the film wrapping or packaging operations proceeds vertically upwardly from the lowermost position as illustrated in FIG. 5. It is therefore to be noted that during the film wrapping or packaging operation, the relative disposition of the framework 118 and the ring or track member 120 upon which the film dispensing carriage assembly, not shown, is mounted, and that of the slip sheet tab folding post support framework 138 upon which the tab folding posts 164-164,168-168,172-172, 176-176 are mounted, will be maintained such that as the wrapping or packaging film is wrapped around the palletized load 115, the tab folding posts 164-164,168-168,172-172, 176-176 maintain their engagement with the downwardly folded tab portions 134 of the slip sheets 132 until the wrapping or packaging film itself engages such downwardly folded tab portions 134 of the slip sheets 132 and maintains the same in their downwardly states.

Accordingly, during the wrapping or packaging process, only the sensor housings 238–244 will be enveloped within the packaging or wrapping film, and the same will be serially released from each successive layer of wrapping or packaging film as the slip sheet tab folding post support framework 138 is constantly raised along with the framework 118 and the ring or track member 120, upon which the film dispensing carriage assembly, not shown, is mounted, during the spiral wrapping or packaging of the palletized load 115. It may thus be appreciated that at any one time during the entire film wrapping or packaging procedure, only the sensor housings 238–244 are enveloped within the wrapping or packaging film, and in order to facilitate their constant release from the previous wrapping or packaging layers of the packaging or wrapping film, the external surface portions of the sensor housings 238–244 are coated with, for example, polytetrafluoroethylene (TEFLON®). Upon completion of the wrapping or packaging operation or cycle, that is, when the top of the palletized load 115 is reached, the slip sheet tab folding post support framework 138 is moved to the uppermost END position which corresponds in effect to the START position of FIG. 3 such that the tab folding posts 164-164,168-168,172-172,176-176 are clear of the upper extent of the palletized load 115, and the framework 118 and the ring or track member 120, upon which the film dispensing carriage assembly, not shown, is mounted, continues to be operated so as to apply the final wrapping or packaging film to the palletized load 115 whereupon the wrapping or packaging film wrapped upon the palletized load 115 will be ultimately sealed and cut by suitable means, not shown.

Following such procedures, the framework 118 and the ring or track member 120, upon which the film dispensing carriage assembly, not shown, is mounted, are moved upwardly still further to their END positions as shown in FIG. 6, which in effect correspond to the START positions of FIG. 3, so as to likewise now be clear of the upper extent of the palletized load 115, the platen 248 is released from the uppermost slip sheet 132 as a result of the appropriate action of the pneumatic actuator 246 by means of a suitable command signal from the central processing unit (CPU) 228, and the conveyor 114 is also activated so as to convey the wrapped or packaged palletized load 115 out from the wrapping or packaging station 116. The machine 110 is therefore readied for the performance of a new film packaging or wrapping operation to be performed upon a new palletized load.

Thus, it may be seen that in accordance with the principles and teachings of the present invention, there has been provided a new and improved film wrapping or packaging machine having incorporated therein a new and improved mechanism or system for implementing the downward folding of outwardly projecting edge or tab portions of slip sheets interposed between successive tiers, levels, or layers of articles or goods forming a palletized load. The folding mechanism or system comprises a plurality of vertically oriented posts which are initially disposed above the outwardly projecting tab portions, subsequently independently aligned with outer edge portions of the outwardly projecting tab portions of the slip sheets, and thereafter lowered so as to engage the tab portions of the slip sheets and fold the same vertically downwardly against the vertical sides of the palletized load such that the downwardly folded tab portions can now be enveloped within the wrapping or packaging film. As the wrapping or packaging film constantly envelops the downwardly folded tab portions, the vertically oriented posts are being moved upwardly so as to constantly be released from their engagement positions with the tab portions until the wrapping or packaging operation or cycle is completed. It can therefore be appreciated that the tab portions of the slip sheets have been folded downwardly and maintained in such folded states such that the tab portions no longer present any problems or difficulties in connection with the uniform and tight wrapping or packaging of the palletized load within the wrapping or packaging film, and in addition, such outwardly projecting tab portions are not able to puncture or tear the wrapping or packaging film so as not to adversley affect the structural integrity of the wrapping or packaging film as well as the structural integrity of the integrated palletized load.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. A method for wrapping a palletized load, comprising a plurality of slip sheets interposed between vertically stacked layers of articles, within plastic film wrapping material, comprising the steps of:

positioning a palletized load, comprising a plurality of slip sheets interposed between vertically stacked layers of articles, at a wrapping station, defined within a fixed upstanding framework, at which the palletized load is to be wrapped;

positioning a plastic film wrapping material dispensing assembly upon said fixed upstanding framework in preparation for a plastic film wrapping operation to be performed upon the palletized load;

positioning a vertically movable framework, having a plurality of vertically oriented posts mounted thereon, at an upper position upon said fixed upstanding framework;

lowering said vertically movable framework along said fixed upstanding framework so as to permit said plurality of vertically oriented posts to engage outwardly projecting edge portions of the slip sheets and fold the outwardly projecting edge portions of the slip sheets downwardly; and raising said plastic film wrapping material dispensing assembly along said fixed upstanding framework so as to perform a plastic film wrapping operation upon the palletized load whereby the downwardly folded edge portions of the slip sheets will be maintained in their downwardly folded states as a result of the downwardly folded edge portions of the slip sheets being encased within the plastic film wrapping material wrapped around the palletized load.

2. The method as set forth in claim 1, further comprising the step of:

raising said vertically movable framework along said fixed upstanding framework and along with said plastic film wrapping material dispensing assembly so as to permit lower end portions of said plurality of vertically oriented posts to be released from their engaged positions with the downwardly folded edge portions of the slip sheets and to be released from wrapped layers of the plastic film wrapping material wherein the downwardly folded edge portions of the slip sheets will be maintained in their downwardly folded states as a result of the downwardly folded edge portions of the slip sheets being encased within the plastic film wrapping material wrapped around the palletized load.

3. The method as set forth in claim 2, further comprising the step of:

coating said lower end portions of said plurality of vertically oriented posts with polytetrafluoroethylene so as to facilitate said release of said lower end portions of said plurality of vertically oriented posts from the wrapped layers of the plastic film wrapping material.

4. The method as set forth in claim 1, further comprising the step of:

fixedly mounting at least one of said vertically oriented posts upon each one of a plurality of framework members of said vertically movable framework wherein said framework members are arranged in opposed pairs which are movable toward and away from each other so as to accommodate different sized palletized loads.

5. The method as set forth in claim 4, further comprising the step of:

mounting a plurality of actuator mechanisms upon an outer framework portion of said vertically movable framework and operatively connecting said plurality of actuator mechanisms to each one of said movable framework members for moving said plurality of movable framework members toward and away from each other.

6. The method as set forth in claim 5, further comprising the steps of:

providing a central processing unit (CPU) for operative connection to said plurality of actuator mechanisms; and respectively providing sensor means upon each one of said plurality of vertically oriented posts for detecting the positional presence of the outwardly projecting edge portions of the slip sheets and for transmitting signals to said central processing unit (CPU) such that said central processing unit (CPU) can control the actuation of said plurality of actuator mechanisms in order to terminate movement of said framework members and said vertically oriented posts when an outwardly projecting edge portion of a slip sheet is detected.

7. The method as set forth in claim 6, further comprising the step of:

mounting said plurality of actuator mechanisms upon said first outer framework so as to be separately connected to each one of said movable framework members such that each one of said movable framework members is independently movable relative to all of the other ones of said plurality of framework members.

8. The method as set forth in claim 6, further comprising the step of:

using position-feedback pneumatic actuator mechanisms as said plurality of actuator mechanisms such that said central processing unit (CPU), operatively connected to said plurality of actuator mechanisms, can maintain the disposition of said plurality of actuator mechanisms at predetermined locations so as to in turn maintain the disposition of said vertically oriented posts with respect to the outwardly projecting edge portions of the slip sheets.

9. A method for wrapping a palletized load, comprising a plurality of slip sheets interposed between vertically stacked layers of articles, within plastic film wrapping material, comprising the steps of:

positioning a palletized load, comprising a plurality of slip sheets interposed between vertically stacked layers of articles, at a wrapping station, defined within a fixed upstanding framework, at which the palletized load is to be wrapped;

positioning a plastic film wrapping material dispensing assembly upon said fixed upstanding framework in preparation for a plastic film wrapping operation to be performed upon the palletized load;

positioning a vertically movable framework, having a plurality of vertically oriented posts mounted thereon, at an upper position upon said fixed upstanding framework;

lowering said vertically movable framework along said fixed upstanding framework so as to permit said plurality of vertically oriented posts to engage outwardly projecting edge portions of the slip sheets and fold the outwardly projecting edge portions of the slip sheets downwardly; and raising said plastic film wrapping material dispensing assembly along said fixed upstanding framework so as to perform a plastic film wrapping operation upon the palletized load, while said plurality of vertically oriented posts initially maintain the downwardly folded edge portions of the slip sheets in their downwardly folded states, whereby the downwardly folded edge portions of the slip sheets will be subsequently maintained in their downwardly folded states as a result of the downwardly folded edge portions of the slip sheets being encased within the plastic film wrapping material wrapped around the palletized load.

10. The method as set forth in claim 9, further comprising the step of:

raising said vertically movable framework along said fixed upstanding framework and along with said plastic film wrapping material dispensing assembly so as to permit lower end portions of said plurality of vertically oriented posts to be progressively released from their engaged positions with the downwardly folded edge portions of lower ones of the slip sheets, and to be progressively released from wrapped layers of the plastic film wrapping material, as said vertically movable framework is progressively raised along said fixed upstanding framework, wherein the downwardly folded edge portions of the slip sheets will be maintained in their downwardly folded states as a result of the downwardly folded edge portions of the slip sheets being encased within the plastic film wrapping material wrapped around the palletized load.

11. The method as set forth in claim 10, further comprising the step of:

coating said lower end portions of said plurality of vertically oriented posts with polytetrafluoroethylene so as to facilitate said release of said lower end portions of said plurality of vertically oriented posts from the wrapped layers of the plastic film wrapping material.

12. The method as set forth in claim 9, further comprising the step of:

fixedly mounting at least one of said vertically oriented posts upon each one of a plurality of framework members of said vertically movable framework wherein said framework members are arranged in opposed pairs which are movable toward and away from each other so as to accommodate different sized palletized loads.

13. The method as set forth in claim 12, further comprising the step of:

mounting a plurality of actuator mechanisms upon an outer framework portion of said vertically movable framework and operatively connecting said plurality of actuator mechanisms to each one of said movable framework members for moving said plurality of movable framework members toward and away from each other.

14. The method as set forth in claim 13, further comprising the steps of:

providing a central processing unit (CPU) for operative connection to said plurality of actuator mechanisms; and respectively providing sensor means upon each one of said plurality of vertically oriented posts for detecting the positional presence of the outwardly projecting edge portions of the slip sheets and for transmitting signals to said central processing unit (CPU) such that said central processing unit (CPU) can terminate movement of said framework members and said vertically oriented posts when an outwardly projecting edge portion of a slip sheet is detected.

15. The method as set forth in claim 14, further comprising the step of:

mounting said plurality of actuator mechanisms upon said first outer framework so as to be separately connected to each one of said movable framework members such that each one of said movable framework members is independently movable relative to all of the other ones of said plurality of framework members.

16. The method as set forth in claim 14, further comprising the step of:

using position-feedback pneumatic actuator mechanisms as said plurality of actuator mechanisms such that said central processing unit (CPU), operatively connected to said plurality of actuator mechanisms, can maintain the disposition of said plurality of actuator mechanisms at predetermined locations so as to in turn maintain the disposition of said vertically oriented posts with respect to the outwardly projecting edge portions of the slip sheets.

17. A method for downwardly folding outwardly projecting edge portions of slip sheets interposed between vertically stacked layers of articles forming a palletized load, to be wrapped in plastic film wrapping material at a wrapping station defined within a fixed upstanding framework of a film wrapping machine, comprising the steps of:

positioning a vertically movable framework, having a plurality of vertically oriented posts mounted thereon, at an upper position upon said fixed upstanding framework such that said plurality of vertically oriented posts are disposed above the palletized load disposed at said wrapping station;

moving said plurality of vertically oriented posts with respect to said vertically movable framework until said vertically oriented posts are aligned with the outwardly projecting edge portions of the slip sheets of the palletized load; and lowering said vertically movable framework along said fixed upstanding framework so as to permit said plurality of vertically oriented posts to engage the outwardly projecting edge portions of the slip sheets and fold the outwardly projecting edge portions of the slip sheets downwardly in preparation for a film wrapping operation.

18. The method as set forth in claim 17, further comprising the step of:

fixedly mounting at least one of said vertically oriented posts upon each one of a plurality of framework members of said vertically movable framework wherein said framework members are arranged in opposed pairs which are movable toward and away from each other so as to accommodate different sized palletized loads.

19. The method as set forth in claim 18, further comprising the step of:

mounting a plurality of actuator mechanisms upon an outer framework portion of said vertically movable framework and operatively connecting said plurality of actuator mechanisms to each one of said movable framework members for moving said plurality of movable framework members toward and away from each other.

20. The method as set forth in claim 19, further comprising the steps of:

providing a central processing unit (CPU) for operative connection to said plurality of actuator mechanisms; and respectively providing sensor means upon each one of said plurality of vertically oriented posts for detecting the positional presence of the outwardly projecting edge portions of the slip sheets and for transmitting signals to said central processing unit (CPU) such that said central processing unit (CPU) can terminate movement of said framework members and said vertically oriented posts when an outwardly projecting edge portion of a slip sheet is detected.

21. The method as set forth in claim 20, further comprising the step of:

mounting said plurality of actuator mechanisms upon said first outer framework so as to be separately connected to each one of said movable framework members such that each one of said movable framework members is independently movable relative to all of the other ones of said plurality of framework members.

* * * * *